US008252705B2

(12) United States Patent
King et al.

(10) Patent No.: US 8,252,705 B2
(45) Date of Patent: Aug. 28, 2012

(54) TURF REINFORCEMENT EROSION CONTROL MAT

(75) Inventors: Kevin Nelson King, Alto, GA (US); David Michael Jones, Dacula, GA (US); Greg L. Maxwell, Pendergrass, GA (US)

(73) Assignee: Nicolon Corporation, Pendergrass, GA (US)

( * ) Notice: Subject to any disclaimer, the term of this patent is extended or adjusted under 35 U.S.C. 154(b) by 403 days.

(21) Appl. No.: 12/729,915

(22) Filed: Mar. 23, 2010

(65) Prior Publication Data

US 2010/0248574 A1 Sep. 30, 2010

Related U.S. Application Data

(60) Provisional application No. 61/162,917, filed on Mar. 24, 2009.

(51) Int. Cl.
*D03D 11/00* (2006.01)
*B32B 5/26* (2006.01)

(52) U.S. Cl. ..... 442/205; 442/203; 442/239; 442/243; 442/301; 442/303

(58) Field of Classification Search ..... 442/203, 442/205, 239, 243, 301, 303
See application file for complete search history.

(56) References Cited

U.S. PATENT DOCUMENTS 2,972,000 A * 2/1961 Boriolo ..... 429/140
4,048,399 A * 9/1977 Terzaghi ..... 429/141
4,762,581 A * 8/1988 Stancliffe et al. ..... 156/84

* cited by examiner

*Primary Examiner* — Andrew Piziali
(74) *Attorney, Agent, or Firm* — Cantor Colburn LLP

(57) ABSTRACT

A bi-layer, woven geotextile fabric has interwoven first and second layers. The first layer is over and under woven through the second layer in a pre-determined pattern so that the first layer has portions which face a first side of the second layer and portions which face a second side of the second layer. Monofilaments in the warp direction of the first layer have a pre-determined differential heat shrinkage characteristic that is greater than the monofilaments in the warp direction of the second layer. Closed cells defined by the pattern of the over and under weave are disposed on the first and second sides of the second layer. Shrinkage of the monofilaments in the warp direction of the first layer provide for a separation of a portion of the second layer from the first layer at the cells.

40 Claims, 4 Drawing Sheets

TURF REINFORCEMENT EROSION CONTROL MAT

CROSS-REFERENCE TO RELATED APPLICATION

This application claims benefit of U.S. Provisional Patent Application Ser. No. 61/162,917 filed Mar. 24, 2009, which is incorporated herein in its entirety by reference.

TECHNICAL FIELD OF THE INVENTION

The present invention relates generally to woven geotextile fabrics. More specifically, the present invention is related to bi-layer woven geotextile fabrics which inhibit or reduce soil erosion and promote seed germination and root stabilization in the soil.

BACKGROUND OF THE INVENTION

During the construction of structures, buildings, bridges, roadways, airfields, dikes, dams, culverts, and the like, it is common to grade the landscape, disturb the surrounding soil, and remove adjacent vegetation to leave bare soil. It is well know that water runoff and wind cause bare soil to erode. Soil erosion is problematic from soil stabilization, environmental contamination, and cost perspectives. These problems are exacerbated when non-stabilized soil is on steepened slopes and channels where the speed of water runoff is accelerated. Typically, crushed stone, rip-rap, mulch, straw, and the like are placed on non-stabilized soil to reduce or prevent soil erosion. However, this solution does not always provide satisfactory results, often requires routine maintenance, and can be expensive.

It is well known that vegetation ground cover is excellent for stabilizing soil and preventing erosion. However, it is difficult to promote plant growth among crushed stone and rip-rap. Even when an occasional plant does grow among the stone or rocks, there is insufficient plant density to be effective in retaining the soil.

Certain geotextile fabrics have been employed to retain soil. However, a similar problem exists as with stone. That is, it is difficult to establish sufficient plant density to create a stabilizing interlocking plant root system for long-lasting soil stabilization.

Accordingly, there is a need for a woven geotextile fabric which can inhibit or eliminate soil erosion on non-stabilized soil and promote seed germination and root stabilization, even on steepened slopes and channels. It is to solving this problem the present invention is directed.

SUMMARY OF THE INVENTION

In accordance with the present invention, a bi-layer, woven geotextile fabric which can be employed as a turf reinforcement soil erosion control mat is described herein. The fabric has interwoven first and second layers. The first layer comprises monofilaments respectively woven in the warp and fill directions and has first and second sides. Similarly, the second layer comprises monofilaments respectively woven in the warp and fill directions. The second layer is over and under woven through the first layer in a pre-determined pattern so that the second layer has portions which face the first side of the first layer and portions which face the second side of the first layer. Monofilaments in the warp direction of the first layer have a pre-determined differential heat shrinkage characteristic that is greater than the monofilaments in the warp direction of the second layer. Further, the fabric has cells disposed on the first and second sides of the first layer. The cells are respectively defined by the pattern of the over and under weave of the second layer, and each cell defines a permeable, enclosed cavity.

Upon being exposed to sufficient heat and/or temperature, the monofilaments in the warp direction of the first layer shrink to a greater degree than the monofilaments of the second layer due to the greater differential heat shrinkage characteristic. Such shrinkage of the monofilaments in the warp direction of the first layer provides for a separation of a portion of the second layer from the first layer at the cells.

Alternatively, the warp and fill monofilaments of the first layer can comprise the same material. Further, the warp and fill monofilaments of the second layer can comprise the same material.

In another aspect of the present invention, the bi-layer, woven geotextile fabric comprises interwoven first and second layers. First and second layers comprise monofilaments respectively woven in warp and fill directions. The first layer has first and second sides. Further, the second layer is over and under woven through the first layer in a pre-determined pattern so that the second layer has portions which face the first side of the first layer and portions which face the second side of the first layer. Monofilaments in the warp and fill directions of the first layer have a pre-determined differential heat shrinkage characteristic greater than the respective monofilaments in the warp and fill directions of the second layer. Additionally, cells are disposed on the first and second sides of the first layer and are defined by the pattern of the over and under weave of the second layer. Each cell defines a permeable, enclosed cavity.

Still, in another aspect of the present invention, the bi-layer, woven geotextile fabric comprises interwoven first and second layers. Each layer has monofilaments respectively woven in the warp and fill directions. The first layer has first and second sides. The second layer is over and under woven through the first layer in a pre-determined pattern so that the second layer has portions which face the first side of the first layer and portions which face the second side of the first layer. Cells are disposed on the first and second sides of the first layer and are respectively defined by the pattern of the over and under weave of the second layer. Each cell defines a permeable, enclosed cavity and has a portion of the first layer that is spaced apart from a portion of the second layer.

Yet, in another aspect of the present invention, the bi-layer, woven geotextile fabric comprises interwoven first and second layers. Each layer has monofilaments respectively woven in the warp and fill directions. The monofilaments of the first layer comprise polyethylene. Polypropylene monofilaments comprise the second layer. The second layer is over and under woven through the first layer in a pre-determined pattern so that the second layer has portions which face the first side of the first layer and portions which face the second side of the first layer. Cells are disposed on the first and second sides of the first layer and are defined respectively by the pattern of the over and under weave of the second layer. Each cell defines a permeable, enclosed cavity.

Upon being exposed to sufficient heat and/or temperature, the monofilaments in the warp direction of the first layer shrink to a greater degree than the monofilaments of the second layer due to the greater differential heat shrinkage characteristic. Such shrinkage of the monofilaments in the warp direction of the first layer provides for a separation of a portion of the second layer from the first layer at the cells.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the present invention. It is important, therefore, that the claims be regarded as including such equivalent constructions insofar as they do not depart from the spirit and scope of the present invention.

Other advantages and capabilities of the present invention will become apparent from the following description taken in conjunction with the accompanying drawings showing the elements and the various aspects of the present invention.

BRIEF DESCRIPTION OF THE OF DRAWINGS

The disclosure below makes reference to the annexed drawings wherein.

DETAILED DESCRIPTION OF THE INVENTION

Figure 1:
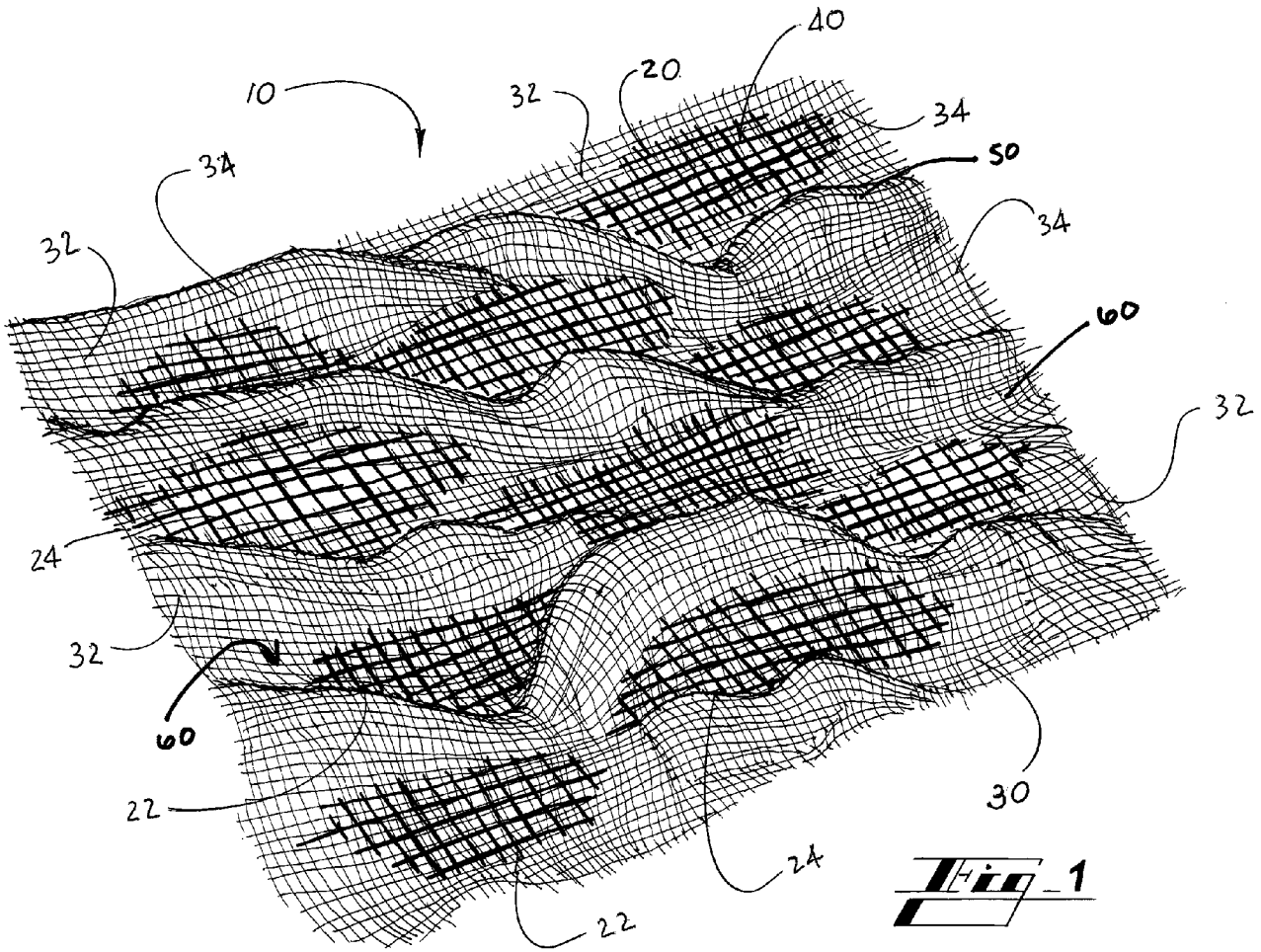
FIG. 1 is a perspective view of a turf reinforcement erosion control mat in accordance with the present invention.

A turf reinforcement erosion control mat (TREC) in accordance with the present invention, also referred to herein as a bi-layer geotextile fabric, can be employed to reduce or eliminate soil erosion. Further, the TREC can be employed to promote seed germination, root stabilization, and vegetative reinforcement.

The TREC is a bi-layer, woven geotextile fabric which has interwoven first and second layers. The first layer comprises monofilaments or yarns respectively in the warp direction woven with yarns in the weft or fill direction. Additionally, the first layer has first and second sides. Similarly, the second layer comprises monofilaments respectively woven in the fill direction and has first and second sides. The second layer is over and under woven through the first layer in a pre-determined pattern so that the second layer has portions which face the first side of the first layer and portions which face the second side of the first layer. Monofilaments in the warp direction of the first layer have a pre-determined differential heat shrinkage characteristic that is greater than the monofilaments in the warp direction of the second layer. Further, the fabric has cells disposed on the first and second sides of the first layer. The cells are respectively defined by the pattern of the over and under weave of the second layer, and each cell defines a permeable, enclosed cavity.

Monofilaments which have a greater differential heat shrinkage characteristic are referred to as shrink yarns. Shrink yarns have greater shrinkage than non-shrink yarns when exposed to the same heat and/or temperature conditions. It is understood that non-shrink yarns can nominally shrink. However, such shrinkage is relatively insignificant as compared to the degree or amount of shrinkage of the shrink yarns at like heat and/or temperature conditions. In other words, the shrink yarns shrink more than the non-shrink yarns under the same heat and/or temperature conditions. Accordingly, upon being exposed to a sufficient duration of heating at a sufficient temperature, the monofilaments in the warp direction of the first layer shrink to a greater degree than the monofilaments in the warp direction of the second layer. This difference in shrinkage is due to the greater differential heat shrinkage characteristic of the monofilaments in the warp direction of the first layer with respect to the monofilaments in the warp direction of the second layer. Such shrinkage of the monofilaments in the warp direction of the first layer provides for a separation of a portion of the second layer from the first layer at the cells.

Alternatively, the warp and fill monofilaments of the first layer can comprise the same material. Alternatively, both the warp and fill monofilaments of the first layer can be shrink yarns, even though such shrink yarns can comprise different polymers. Further, the warp and fill monofilaments of the second layer can be the same or different non-shrink yarns.

In another aspect of the present invention, the bi-layer, woven geotextile fabric comprises interwoven first and second layers. Both layers comprise monofilaments respectively woven in warp and fill directions. The first layer has first and second sides. Further, the second layer is over and under woven through the first layer in a pre-determined pattern so that the second layer has portions which face the first side of the first layer and portions which face the second side of the first layer. Monofilaments in the warp and fill directions of the first layer have a pre-determined differential heat shrinkage characteristic greater than the respective monofilaments in the warp and fill directions of the second layer. Additionally, cells are disposed on the first and second sides of the first layer and are defined by the pattern of the over and under weave of the second layer. Each cell defines a permeable, enclosed cavity.

Still, in another aspect of the present invention, the bi-layer, woven geotextile fabric comprises interwoven first and second layers. Each layer has monofilaments respectively woven in the warp and fill directions. The first layer has first and second sides. The second layer is over and under woven through the first layer in a pre-determined pattern so that the second layer has portions which face the first side of the first layer and portions which face the second side of the first layer. Cells are disposed on the first and second sides of the first layer and are respectively defined by the pattern of the over and under weave of the second layer. Each cell defines an enclosed cavity and has a portion of the first layer that is spaced apart from a portion of the second layer.

Yet, in another aspect of the present invention, the bi-layer, woven geotextile fabric comprises interwoven first and second layers. Each layer has monofilaments respectively woven in the warp and fill directions. The monofilaments of the first layer comprise polyethylene. Polypropylene monofilaments comprise the second layer. The second layer is over and under woven through the first layer in a pre-determined pattern so that the second layer has portions which face the first side of the first layer and portions which face the second side of the first layer. Cells are disposed on the first and second sides of the first layer and are defined respectively by the pattern of the over and under weave of the second layer. Each cell defines a permeable, enclosed cavity.

Upon being exposed to sufficient heat and/or temperature conditions, the polyethylene monofilaments in the warp direction of the first layer shrink to a greater degree than the polypropylene monofilaments of the second layer due to the greater differential heat shrinkage characteristic of polyethylene. Such shrinkage of the monofilaments in the warp direction of the first layer provides for a separation of a portion of the second layer from the first layer at the cells.

For a fuller understanding of this disclosure and the invention described therein, reference should be made to the above and following detailed description taken in connection with the accompanying figures. When reference is made to the figures, like reference numerals designate corresponding parts throughout the several figures. With reference to FIG. 1, the bi-layer, woven geotextile fabric 10 includes a first layer 20 and a second layer 30. First layer 20 comprises warp yarn 22 that is woven together with weft or fill yarn 24. Similarly, the second layer 30 comprises warp yarn 32 that is woven together with fill yarn 34 and has a first side 36 and a second side 38. Moreover, first layer 20 is over and under woven through the second layer 30.

As discussed above, warp yarn 22 is shrink yarn. In another aspect of the invention, fill yarn 24 is shrink yarn. Still, in another aspect, the warp and fill yarns 22, 24 can be the same or different shrink yarn. The non-shrink warp and fill yarns 32, 34 of the second layer 30 can be the same or different. The independent shrink and non-skrinker yarn systems are woven together so that the positioning of the shrink yarns dictate the properties of the finished fabric such as: thickness, bi-layer and multi-axial root support, opening sizes, strength, weight, stiffness, and width.

As known in the art, a woven fabric has two principle directions, one being the warp direction and the other being the weft direction. The weft direction is also referred to as the fill direction. The warp direction is the length wise, or machine direction of the fabric. The fill or weft direction is the direction across the fabric, from edge to edge, or the direction traversing the width of the weaving machine. Thus, the warp and fill directions are generally perpendicular to each other. The set of yams, threads, or monofilaments running in each direction are referred to as the warp yarns and the fill yarns, respectively.

A woven fabric can be produced with varying densities. This is usually specified in terms of number of the ends per inch in each direction, warp and fill. The higher this value is, the more ends there are per inch and, thus, the fabric density is greater or higher. Although not required, it is beneficial for seed germination and propagation of a root system for the respective fabric densities of the first and second layers to be sufficiently low that adjacent monofilaments in the warp and fill directions do not contact one another. However, it is within the scope of the invention if either or both the first and second layers have a plurality of warp yarns contacting one another and/or a plurality of fill yarns contacting one another. Further, the fabric density of the first layer 20 is between 5 and 30 ends/inch in the warp and fill directions, independently. In another aspect, the fabric density of the first layer 20 in the warp direction is 5, 6, 7, 8, 9, 10, 11, 12, 13, 14, 15, 16, 17, 18, 19, 20, 21, 22, 23, 24, 25, 26, 27, 28, 29, or 30 ends/inch. Likewise, in another aspect, the fabric density of the first layer 20 in the fill direction is 5, 6, 7, 8, 9, 10, 11, 12, 13, 14, 15, 16, 17, 18, 19, 20, 21, 22, 23, 24, 25, 26, 27, 28, 29, or 30 ends/inch. Similarly, the fabric density of the second layer 30 is between 5 and 40 ends/inch in the warp and fill directions, independently. In another aspect, the fabric density of the second layer 30 is between 10 and 40 ends/inch in the warp and fill directions, independently. Yet, in another aspect, the fabric density of the second layer 30 in the warp direction is 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40 ends/inch. Likewise, in another aspect, the fabric density of the second layer 30 in the fill direction is 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40 ends/inch.

The weave pattern of fabric construction is the pattern in which the warp yarns are interlaced with the fill yarns. A woven fabric is characterized by an interlacing of these yarns. There are many variations of weave patterns commonly employed in the textile industry, and those of ordinary skill in the art are familiar with most of the basic patterns. While it is beyond the scope of the present application to include a disclosure of these multitude of weave patterns, the basic plain, twill, satin, honeycomb weave patterns can be employed with the present invention. However, such patterns are only illustrative, and the invention is not limited to such patterns. It should be understood that those of ordinary skill in the art will readily be able to determine how a given weave pattern could be employed in practicing the present invention in light of the parameters herein disclosed.

Plain weave is characterized by a repeating pattern where each warp yarn is woven over one fill yarn and then woven under the next fill yarn, as illustrated in FIGS. 1-5. As mentioned above, but not required, spacing between warp and fill yarns of the first and second layers, respectively, is maintained to provide sufficient space for vegetation to germinate and grow therethrough.

A twill weave, relative to the plain weave, has fewer interlacings in a given area. The twill is a basic type of weave, and there are a multitude of different twill weaves. A twill weave is named by the number of fill yarns which a single warp yarn goes over and then under. For example, in a 2/2 twill weave, a single warp end weaves over two fill yarns and then under two fill yarns. In a 3/1 twill weave, a single warp end weaves over three fill yarns and then under one fill yarn. For fabrics being constructed from the same type and size of yarn, with the same thread or monofilament densities, a twill weave has fewer interlacings per area than a corresponding plain weave fabric.

A satin weave, relative to the twill and plain weaves, has fewer interlacings in a given area. It is another basic type of weave from which a wide array of variations can be produced. A satin weave is named by the number of ends on which the weave pattern repeats. For example, a five harness satin weave repeats on five ends and a single warp yarn floats over four fill yarns and goes under one fill yarn. An eight harness satin weave repeats on eight ends and a single warp yarn floats over seven fill yarns and passes under one fill yarn. For fabrics being constructed from the same type of yarns with the same yarn densities, a satin weave has fewer interlacings than either a corresponding plain or twill weave fabric.

Three-dimensional weave patterns can also be employed in the present invention. These weave patterns include honeycomb, diamond, double cloth, crepe, and huckaback. For example, a honeycomb weave pattern is disclosed in U.S. Pat. No. 5,567,087, the entire disclosure of which is incorporated herein by reference. The monofilaments employed in the honeycomb pattern layer can be biaxially heat shrinkable. That is, upon being heated, the filament yarns shrink in both directions.

The process for making geotextile fabrics is well known in the art. Thus, the weaving process employed can be performed on any conventional textile handling equipment suitable for producing the fabric of the present invention. Further, any of the aforementioned patterns weaves may be employed for either or both the first and second layers.

Figure 2:
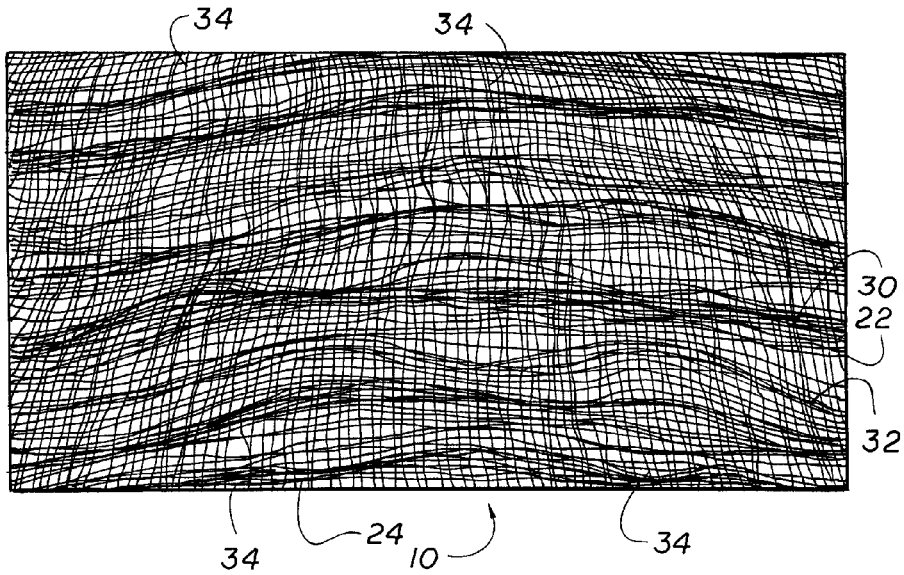
FIG. 2 is an illustration in perspective view of a pre-tentered turf reinforcement erosion control mat in accordance with the present invention.

As mentioned above, the first layer 20 is over and under woven through the second layer 30, as illustrated in FIGS. 1-6. That is, a portion of the first layer 20 faces the first side 36 of the second layer 30 and another portion of the first layer 20 faces the second side 38 of the second layer 30. This over and under weave is repeated and offset in the warp and fill directions to create various patterns or blocks on the first and second sides 36, 38 of the second layer 30. The appearance is reminiscent of a "checkerboard". This offset is illustrated in FIGS. 1, 2, 5, and 6. FIG. 2 is a "flat" TREC, that is, the fabric 10 has been woven, but not tentered. Tentered means that the fabric 10 has been subjected to sufficient heat and/or temperature conditions and duration to shrink the shrink yarns. Alternatively stated, the shrink first layer 20 is woven on top of the non-shrink second layer 30 in a block, while the non-shrink second layer 30 is woven on top of the shrink first layer 20. This pattern alternates and repeats, so that there are alternating blocks of yarns showing on both sides of the woven fabric. These yarns in themselves are also woven into independent structures that are single layer fabrics. It can be seen in FIG. 2 that portions of the first layer 20 in a rectangular pattern are disposed on the first side 36 of the second layer 30 and portions of the first layer 20 are disposed on the second side 38 of the second layer 30. Further, it can be seen in FIG. 2 that the pattern is offset in repeating fashion. The rectangular pattern is provided for illustration only and should not be deemed limiting. Such patterns include, but are not limited to squares, rectangles, trapezoids, diamonds, circles, ovals, and the like.

Figure 3:
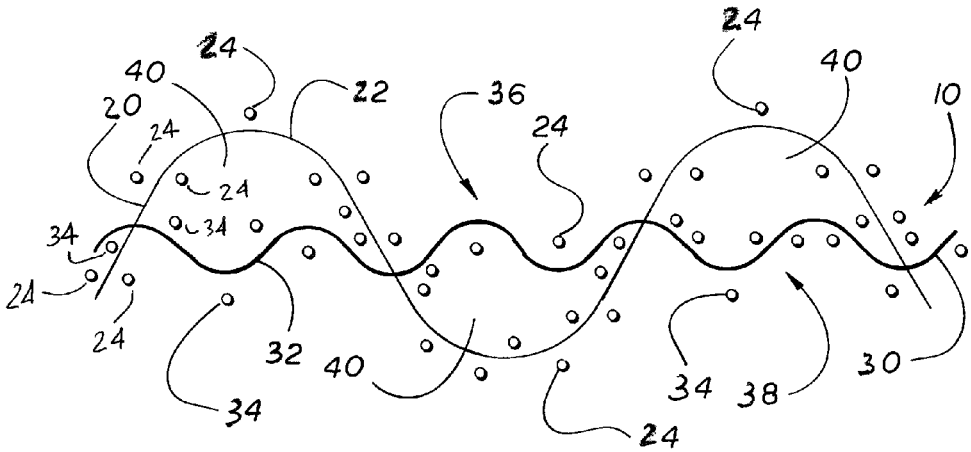
FIG. 3 is a cross-sectional view of the turf reinforcement erosion control mat of FIGS. 1 and 2 illustrating an over and under weave.
Figure 4:
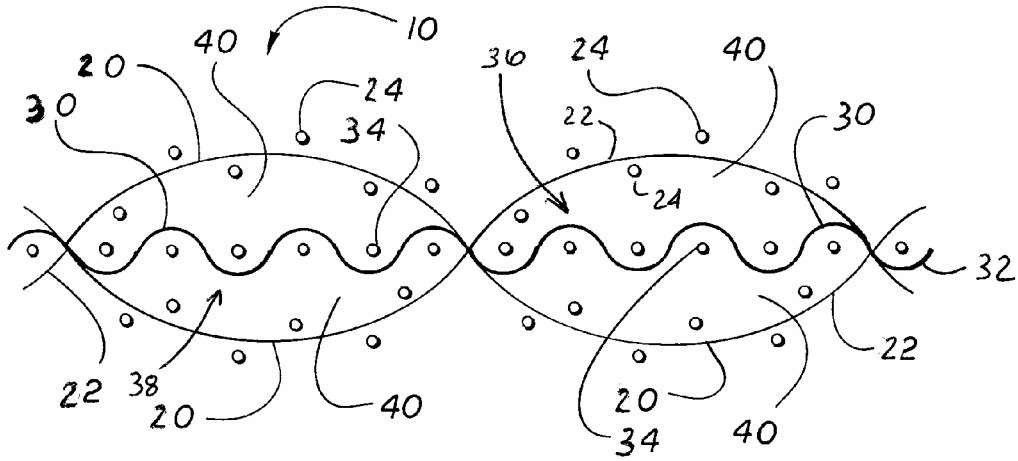
FIG. 4 is another cross-sectional view of the turf reinforcement erosion control mat of FIGS. 1 and 2 illustrating the over and under weave.
Figure 5:
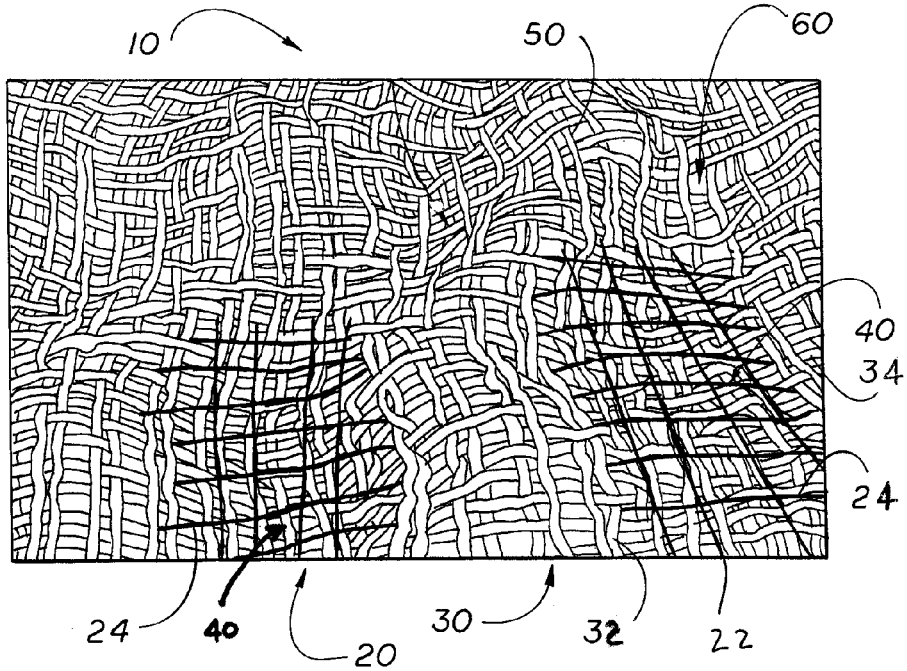
FIG. 5 is another illustration in perspective view of a tentered turf reinforcement erosion control mat in accordance with the present invention.

As a result of the over and under weave patterns of the first layer 20, permeable, closed cells 40 are created within the portion of the first layer 20 facing the first side 36 of the second layer 30. Likewise, permeable, closed cells 40 are created within the portion of the first layer 20 facing the second side 38 of the second layer 30. The cells 40 are illustrated in FIGS. 3-5. FIG. 3 shows an end view of geotextile fabric 10 with the first layer 20 interwoven over and under the second layer 30 in respective plain weaves. FIG. 4 is also an end view of the fabric 10. In this illustration, the offset pattern of the over and under weave of the first layer 20 of the bi-layer fabric 10 is shown. Cells 40, as particularly shown in FIG. 5, are closed on all sides. Further, FIG. 5 is an illustration of a tentered fabric 10.

During the tentering process, such as been exposed to hot water, steam, or heat in a tentering oven under sufficient heat and/or temperature conditions and duration, the shrink yarns shrink and the second layer 30 gathers and forms ridges 50 and valleys 60, as illustrated in FIG. 5. The pattern of the ridges 50 and valleys 60 depends on the weave of the second layer 30 and the over and under woven pattern of the first layer 20. As further illustrated in FIG. 5, tentering causes respective portions of the first and second layers 20, 30 to space apart from one another. Such separation provides for the respective cells 40 to have enclosed, yet permeable, cavities capable of receiving soil and seeds. Further, the cells 40, ridges 50, and valleys 60 provide an irregular shape for water disruption from either rain-splash or shear. Further, because the fabric 10 has two layers of fabrics that are not in the same plane relative to one another after shrinking, the fabric provides for a horizontal network of yarns that support vegetation during the growth cycle.

Without limitation, the tentered fabric 10 typically has a thickness between about 200 mils and about 750 mils. Yet, the tentered fabric 10 can have a thickness which is less than 200 mils or greater than 750 mils. In another aspect, the thickness of the tentered fabric 10 is 200, 250, 300, 350, 400, 450, 500, 550, 600, 650, 700, or 750 mils. The fabric 10 as illustrated in FIG. 5 has a thickness of about 250 mils (0.25 inch).

The fibers or monofilaments comprising the aforementioned yarns are typically thermoplastic polymers. Additionally, yarns comprising natural fibers can be employed in the present invention. Such natural yarns should be selected on their ability to with stand the heat and temperature of the tentering oven without being degraded or burned. Polymers which may be used to produce the geotextile fabric of the present invention include, but are not limited to, polyamides (for example, any of the nylons), polyimides, polyesters (for example, high tenacity polyesters, polyethylene terephthalate, polybutylene terephthalate, and aromatic polyesters, for) example, Vectran®), polyacrylonitriles, polyphenylene oxides, fluoropolymers, acrylics, polyolefins (for example, low density polyethylene (LDPE), linear low density polyethylene (LLDPE), high density polyetheylene (HDPE), copolymers of polyethylene, polypropylene, and higher polyolefins), polyphenylene sulfide, polyetherimide, polyetheretherketone, polylactic acid (also known as polylactide), aramids (for example, para-aramids, which include Kevlar®, Technora®, Twaron®, and meta-paramids, for example, Nomex®, and Teijinconex°, aromatic ether ketones, vinalon, and the like, and blends of such polymers which can be formed into microfilaments. Further, the fibers can comprise other agents, materials, dyes, plasticizers, etc. which are employed in the textile industry. It will be understood that any materials capable of producing fibers or microfilaments suitable for use in the instant fabric of the present invention fall within the scope of the present invention and can be determined without departing from the spirit thereof.

As mentioned above, the respective fibers employed in the present invention can further comprise at least one additive commonly used in conjunction with the material of the fiber. Such additives include, but are not limited to, plasticizers, processing aids, scavengers, heat stablizers, antistatic agents, slip agents, dyes, pigments, antioxidants, ultraviolet light stabilizers, metal deactivators, antistatic agents, flame retardants, lubricants, biostabilizers, and biocides.

The antioxidants, light stabilizers, and metal deactivators employed, if appropriate or desired, can have a high migration fastness and temperature resistance. Suitable antioxidants, light stabilizers, and metal deactivators include, but are not limited to, 4,4-diarylbutadienes, cinnamic esters, benzotriazoles, hydroxybenzophenones, diphenylcyanoacrylates, oxamides (oxalamides), 2-phenyl-1,3,5-triazines; antioxidants, nickel compounds, sterically hindered amines, metal deactivators, phosphites and phosphonites, hydroxylamines, nitrones, amine oxides, benzofuranones and indolinones, thiosynergists, peroxide scavengers, and basic costabilizers.

Examples of suitable antistatic agents include, but are not limited to, amine derivatives such as N,N-bis(hydroxyalkyl) alkylamines or -alkylenamines, polyethylene glycol esters and ethers, ethoxylated carboxylic esters and carboxamides, and glycerol monostearates and distearates, and also mixtures thereof.

The additives are used in typical amounts as provided in the respective product literature. For example, the respective additives, when present, are in an amount from about 0.0001% to 10% by weight based upon the total weight of the fiber. In another aspect, the respective additives are present in an amount from about 0.01% to about 1% by weight based on the total weight of the respective fiber.

Any of the above polymers can be employed as "shrink" yarns, given a particular fabric construction. To recall, the shrink yarn shrinks at a lower temperature than the "non-shrink" yarn. The shrinkage properties are sufficiently different such that one yarn shrinks while the other does not.

Typically, the shrink and non-shrink yarns employed in the present invention further have the following properties:

| | Non-shrink Yarn | Shrink yarn |
|---|---|---|
| Denier | 250-2500 | 150-2500 |
| Tensile strength (lb) | 3 lb-35 lb | 1 lb-20 lb |
| Elongation at brake (%) | 5%-35% | 10%-80% |

Tensile strength and elongation are determined in accordance with American Society for Testing and Materials' (ASTM) Standard Test Method D-2256.

The geometrical cross-sectional shape of the yarns or monofilaments employed in the present invention can be of any shape. For example, the cross-sectional shape can be, but not limited to, round, oval, square, rectangular, trapezoidal, trilobal, multi-lobal, or other geometically-shaped monofilaments.

Figure 6:
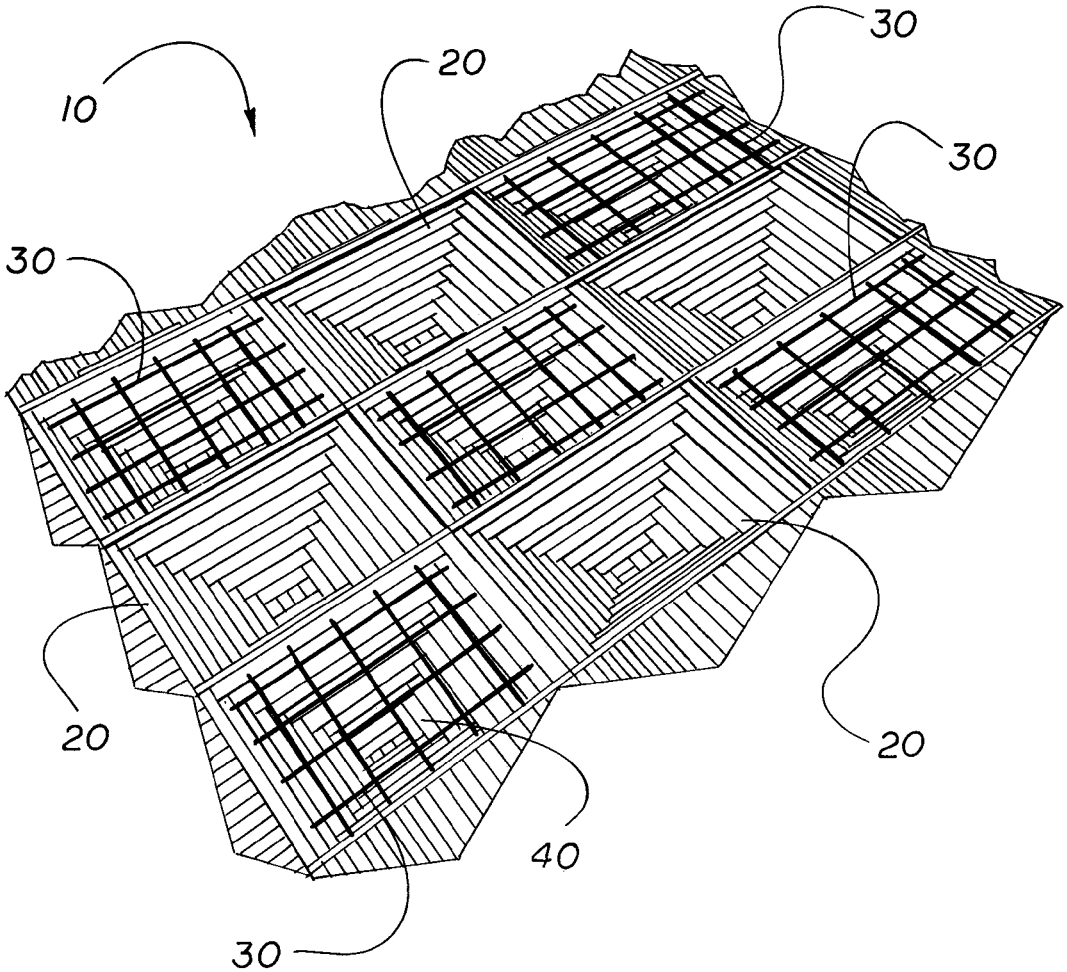
FIG. 6 is a perspective view of the turf reinforcement erosion control mat in accordance with the present invention employing a honeycomb pattern.

Referring to FIG. 6, the fabric 10 has the first layer 20 employing a honeycomb weave pattern. In this aspect, the first layer 20 employs shrink yarns in the warp and fill directions in its construction on a single plane and single layer of fabric. As illustrated, the second layer 30 is blocked in an over and under weave through the first layer 20. As illustrated, the second layer 30 is woven in a plain weave pattern through the second layer 20. As shown, the cells 40 are enclosed by the first and second layers 20, 30.

Again, referring to FIGS. 1-5, the fabric 10 has cells 40 in the bi-layer system which break-up water flow and distributes the forces of rain and water run-off so that the effect of erosion of the underlying soil, seeds, and vegetation are substantially reduced or prevented in comparison to non-protected soil. This effect results in fewer washed out conditions on channels and steepened slopes. The design of the bi-layer structure within the fabric 10 allows provides the ability to reduce the amount of mass and yarns in the lower structure causing a more open weave. This portion of the fabric 10 provides less surface area that touches the ground and less impedance for germination. The soil contact of the fabric 10 is effectively reduced; which facilitates better and faster germination.

Following the weaving process, the fabric 10 is essentially flat. Prior to tentering, the fabric 10 thickness largely depends on the thickness of the respective monofilaments employed to weave the first and second layers 20, 30. Typically, but not required, the pre-tentered fabric 10 has a thickness between about 20 mils and 75 mils. Yet, the pre-tintered fabric 10 can have a thickness which is less than 20 mils or greater than 75 mils. The fabric is then subjected to a heat setting or tentering process. For example, the untentered fabric 10 is placed on a "bed" of open mesh fabric. Thereafter, the fabric 10 is exposed to heat in a tenter oven by pulling the fabric through the hot air with sufficient tension necessary to pull the fabric through the oven. The fabric 10 is allowed to "free-shrink." That is, the fabric is not restrained by mechanical devices such as standard pins or clips. Typically, the fabric is processed through the tenter oven at temperatures of about 200° F.-about 240° F., for example with the shrink yarn is polyethylene and the non-shrink yarn is polypropylene. It is understood by one of ordinary skill in the art that the temperature range to be employed to tenter the fabric is dependent upon the polymer employed as the shrink yarn. Again, the non-shrink yarns are selected such that they do not shrink, or nominally shrink with respect to the shrink yarn, at the tentering temperature. Further, the tentering temperature range can be varied depending upon the desired thickness characteristics of the fabric and the dwell time of the fabric in the tenter oven. The purpose of the tentering process is to subject the bi-layered fabric to sufficient heat for a sufficient duration to permanently shrink the shrink yarn. As mentioned above, the shrinkage effect forces the non-shrink yarns to buckle and create designed shapes that provide germination and root support and can prevent and/or reduce soil loss and erosion.

After the above-described tentering process is conducted on the fabric 10, the respective cells 40 have a length in the warp direction from about 0.40 mils to about 1.3 mils. Similarly, the respective cells 40 have a width in the fill direction from about 0.40 mils to about 1.3 mils. In one aspect, the respective cells have a length and width dimension of 0.87× 0.87 mils. It is readily apparent to one of ordinarily skill in the art that the lengths and widths of the cells 40 of the fabric 10 can be substantially the same or different depending upon the fabric density in the warp and weft directions, respectively. Further, it is also readily apparent to one of ordinary skill in the art that the cells 40 of the fabric 10 can different in size and shape, again, based upon the fabric density in the warp and weft directions, respectfully.

In another aspect of the present invention, after the above-described tentering process is conducted on the fabric 10, the distance between the first and second layers 20, 30 of given cell 40 at the widest point therein is from about 100 mils to about 750 mils. In another aspect of the present invention the distance between the first and second layers 20, 30 of a given cell 40 at the widest point therein is from about 150 mils to about 350 mils. Yet, in another aspect of the present invention the distance between the first and second layers of a cell 40 at the widest point therein is about 200 mils.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A bi-layer, woven geotextile fabric comprising:

a first layer comprising monofilaments respectively woven in warp and fill directions;

a second layer comprising monofilaments respectively woven in warp and fill directions and having first and second sides;

the first layer over and under woven through the second layer in a pre-determined pattern so that the first layer has portions which face the first side of the second layer and portions which face the second side of the second layer;

the monofilaments in the warp direction of the first layer having a pre-determined differential heat shrinkage characteristic greater than the monofilaments in the warp direction of the second layer; and cells disposed on the first and second sides of the second layer and respectively defined by the pattern of the over and under weave of the first layer, and each cell defining a permeable, enclosed cavity.

2. The fabric of claim 1, wherein the fabric is a tentered fabric.

3. The fabric of claim 1, wherein each cell has a portion of the first layer that is spaced apart from a portion of the second layer.

4. The fabric of claim 1, wherein the warp and fill monofilaments of the first layer comprise the same material.

5. The fabric of claim 1, wherein the warp and fill monofilaments of the second layer comprise the same material.

6. The fabric of claim 1, wherein the pattern is a repeating pattern on the first and second sides of the second layer.

7. The fabric of claim 1, wherein the monofilaments are made from polyamides, polyimides, polyesters, polyacrylonitriles, polyphenylene oxides, fluoropolymers, acrylics, polyolefins, polyphenylene sulfide, polyetherimide, polyetheretherketone, polylactic acid, aramids, aromatic ether ketones, vinalon, and any blend of such polymers formable into the monofilament.

8. The fabric of claim 7, wherein the monofilaments include natural fibers.

9. The fabric of claim 1, wherein the monofilaments in the warp direction of the first layer comprise polyethylene and the monofilaments in the warp direction of the second layer comprise polypropylene.

10. The fabric of claim 1, wherein the fabric further comprises at least one additive selected from plasticizers, processing aids, scavengers, heat stablizers, antistatic agents, slip agents, dyes, pigments, antioxidants, ultraviolet light stabilizers, metal deactivators, antistatic agents, flame retardants, lubricants, biostabilizers, or biocides.

11. The fabric of claim 1, wherein the fabric further comprises an ultraviolet light stabilizer.

12. The fabric of claim 2, wherein respective cells have a length in the warp direction from about 0.40 mils to about 1.3 mils and a width in the fill direction from about 0.40 mils to about 1.3 mils, and the measurements of the length and width of a respective cell can be the same or different.

13. The fabric of claim 2, wherein the first and second layers of respective cells are spaced apart at the widest point therein about 200 mils.

14. A bi-layer, woven geotextile fabric comprising:

a first layer comprising monofilaments respectively woven in warp and fill directions;

a second layer comprising monofilaments respectively woven in warp and fill directions and having first and second sides;

the first layer over and under woven through the second layer in a pre-determined pattern so that the first layer has portions which face the first side of the second layer and portions which face the second side of the second layer;

the monofilaments in the warp and fill directions of the first layer having a pre-determined differential heat shrinkage characteristic greater than the respective monofilaments in the warp and fill directions of the second layer; and cells disposed on the first and second sides of the second layer and defined by the pattern of the over and under weave of the first layer, and each cell defining a permeable, enclosed cavity.

15. The fabric of claim 14, wherein the fabric is a tentered fabric.

16. The fabric of claim 14, wherein each cell has a portion of the first layer that is spaced apart from a portion of the second layer.

17. The fabric of claim 14, wherein the pattern is a repeating pattern on the first and second sides of the second layer.

18. The fabric of claim 14, wherein the monofilaments are made from polyamides, polyimides, polyesters, polyacrylonitriles, polyphenylene oxides, fluoropolymers, acrylics, polyolefins, polyphenylene sulfide, polyetherimide, polyetheretherketone, polylactic acid, aramids, aromatic ether ketones, vinalon, any blend of such polymers formable into the monofilament, and natural fibers.

19. The fabric of claim 14, wherein the first layer comprises polyethylene and the second layer comprises polypropylene.

20. The fabric of claim 14, wherein the fabric further comprises at least one additive selected from plasticizers, processing aids, scavengers, heat stablizers, antistatic agents, slip agents, dyes, pigments, antioxidants, ultraviolet light stabilizers, metal deactivators, antistatic agents, flame retardants, lubricants, biostabilizers, or biocides.

21. The fabric of claim 14, wherein the fabric further comprises an ultraviolet light stabilizer.

22. The fabric of claim 15, wherein respective cells have a length in the warp direction from about 0.40 mils to about 1.3 mils and a width in the fill direction from about 0.40 mils to about 1.3 mils, and the measurements of the length and width of a respective cell can be the same or different.

23. A bi-layer, woven geotextile fabric comprising:

a first layer comprising monofilaments respectively woven in warp and fill directions;

a second layer comprising monofilaments respectively woven in warp and fill directions and having first and second sides;

the first layer over and under woven through the second layer in a pre-determined pattern so that the first layer has portions which face the first side of the second layer and portions which face the second side of the second layer; and cells disposed on the first and second sides of the second layer and respectively defined by the pattern of the over and under weave of the first layer, and each cell defining a permeable, enclosed cavity and having a portion of the first layer that is spaced apart from a portion of the second layer.

24. The fabric of claim 23, wherein the warp and fill monofilaments of the first layer comprise the same material.

25. The fabric of claim 23, wherein the warp and fill monofilaments of the second layer comprise the same material.

26. The fabric of claim 23, wherein the monofilaments are made from polyamides, polyimides, polyesters, polyacrylonitriles, polyphenylene oxides, fluoropolymers, acrylics, polyolefins, polyphenylene sulfide, polyetherimide, polyetheretherketone, polylactic acid, aramids, aromatic ether ketones, vinalon, any blend of such polymers formable into the monofilament, and natural fibers.

27. The fabric of claim 23, wherein the first layer comprises polyethylene and the second layer comprises polypropylene.

28. The fabric of claim 23, wherein the fabric further comprises at least one additive selected from plasticizers, processing aids, scavengers, heat stablizers, antistatic agents, slip agents, dyes, pigments, antioxidants, ultraviolet light stabilizers, metal deactivators, antistatic agents, flame retardants, lubricants, biostabilizers, or biocides.

29. The fabric of claim 23, wherein the fabric further comprises an ultraviolet light stabilizer.

30. A bi-layer, woven geotextile fabric comprising:

a first layer comprising polyethylene monofilaments respectively woven in warp and fill directions;

a second layer comprising polypropylene monofilaments respectively woven in warp and fill directions and having first and second sides;

the first layer over and under woven through the second layer in a pre-determined pattern so that the first layer has portions which face the first side of the second layer and portions which face the second side of the second layer; and cells disposed on the first and second sides of the second layer and respectively defined by the pattern of the over and under weave of the first layer, and each cell defining a permeable, enclosed cavity having a portion of the first layer spaced apart from a portion of the second layer.

31. A bi-layer, woven geotextile fabric comprising:

a first layer comprising monofilaments respectively woven in warp and fill directions;

a second layer comprising monofilaments respectively woven in warp and fill directions and having first and second sides;

the first layer over and under woven through the second layer in a pre-determined pattern so that the first layer has portions which face the first side of the second layer and portions which face the second side of the second layer;

the monofilaments in the fill direction of the first layer having a pre-determined differential heat shrinkage characteristic greater than the monofilaments in the fill direction of the second layer; and cells disposed on the first and second sides of the second layer and respectively defined by the pattern of the over and under weave of the first layer, and each cell defining a permeable, enclosed cavity.

32. The fabric of claim 31, wherein the fabric is a tentered fabric.

33. The fabric of claim 31, wherein each cell has a portion of the first layer that is spaced apart from a portion of the second layer.

34. The fabric of claim 31, wherein the pattern is a repeating pattern on the first and second sides of the second layer.

35. The fabric of claim 31, wherein the monofilaments are made from polyamides, polyimides, polyesters, polyacrylonitriles, polyphenylene oxides, fluoropolymers, acrylics, polyolefins, polyphenylene sulfide, polyetherimide, polyetheretherketone, polylactic acid, aramids, aromatic ether ketones, vinalon, any blend of such polymers formable into the microfilament, and natural fibers.

36. The fabric of claim 31, wherein the monofilaments in the fill direction of the first layer comprise polyethylene and the monofilaments in the fill direction of the second layer comprise polypropylene.

37. The fabric of claim 31, wherein the fabric further comprises at least one additive selected from plasticizers, processing aids, scavengers, heat stablizers, antistatic agents, slip agents, dyes, pigments, antioxidants, ultraviolet light stabilizers, metal deactivators, antistatic agents, flame retardants, lubricants, biostabilizers, or biocides.

38. The fabric of claim 31, wherein the fabric further comprises an ultraviolet light stabilizer.

39. The fabric of claim 32, wherein respective cells have a length in the warp direction from about 0.40 mils to about 1.3 mils and a width in the fill direction from about 0.40 mils to about 1.3 mils, and the measurements of the length and width of a respective cell can be the same or different.

40. The fabric of claim 31, wherein the first and second layers of respective cells are spaced apart at the widest point therein about 200 mils.

* * * * *